United States Patent [19]

Culling

[11] Patent Number: 4,915,752

[45] Date of Patent: Apr. 10, 1990

[54] CORROSION RESISTANT ALLOY

[75] Inventor: John H. Culling, St. Louis, Mo.

[73] Assignee: Carondelet Foundry Company, St. Louis, Mo.

[21] Appl. No.: 335,799

[22] Filed: Apr. 10, 1989

Related U.S. Application Data

[63] Continuation-in-part of Ser. No. 243,790, Sep. 13, 1988, abandoned.

[51] Int. Cl.[4] ..... C22C 38/44; C22C 38/42

[52] U.S. Cl. ..... 148/327; 148/325; 420/57; 420/59

[58] Field of Search ..... 148/327, 32 S; 420/52, 420/57, 59

[56] References Cited

U.S. PATENT DOCUMENTS

| | | | |
|---|---|---|---|
| 4,032,367 | 6/1977 | Richardson et al. | 420/57 |
| 4,500,351 | 2/1985 | Bond et al. | 420/52 |
| 4,816,085 | 3/1989 | Flasche et al. | 148/327 |

*Primary Examiner*—Deborah Yee

*Attorney, Agent, or Firm*—Senniger, Powers, Leavitt and Roedel

[57] ABSTRACT

The present invention is directed to air-meltable, castable, workable, weldable duplex alloys of high yield strength as well as high tensile elongations and ductility and which are resistant to chlorides and a wide variety of corrosive chemical streams over a wide range of temperatures and fluid velocities. The alloys consist essentially of, by weight, between 23.8% and 28.5% chromium, from about 3.3% to about 5.6% molybdenum, from about 7.8% to about 11.5% nickel, from about 0.12% to about 0.23% nitrogen, from about 0.8% to about 1.5% copper, up to about 0.8% silicon, up to about 1.2% manganese, and up to about 0.6% tungsten, and the balance essentially iron, wherein the percentage of chromium and molybdenum is within the area ABCA of FIG. 1. Preferred alloys have a narrower percentage range of chromium and molybdenum contents and fall within the area DEFG of FIG. 1.

8 Claims, 1 Drawing Sheet

CORROSION RESISTANT ALLOY

This application is a continuation-in-part of copending application Ser. No. 243,790, filed Sept. 13, 1988, now abandoned.

This invention relates to new stainless steels having a duplex ferrite-austenite microstructure which possess outstanding corrosion resistance to seawater and other chloride environments, as well as oxidizing and reducing solutions. The alloys also possess excellent mechanical properties and can be welded.

BACKGROUND OF THE INVENTION

Every material ever employed in any corrosion application represents some sort of compromise. Not even the precious metals such as gold and platinum can combine all of the best properties possible. The austenitic 18Cr–8Ni alloys evolved as a balance between economic factors and requirements for resistance to various forms of corrosion, and for toughness, formability and weldability. As remarkable as the many variants of the 18Cr–8Ni type alloys have been they are especially vulnerable to failure in seawater or other chloride solutions by local corrosion or stress corrosion cracking.

There has been a somewhat concurrent and parallel evolution of nickel-base alloys, some of which do completely resist seawater and various chloride solutions. Due to the relative scarcity of nickel these alloys have, however, always remained quite expensive compared to stainless steels. They are simply economically not practical for many large tonnage applications.

Similarly recent developments have brought the newer ferritic, iron-chromium-molybdenum alloys to their present state of development and employment. The best of these alloys effectively resist failure in seawater and many other chloride environments. While their resistance to oxidizing substances is outstanding, they have much more limited utility for non-oxidizing conditions. As a result of further development their resistance to reducing conditions was somewhat broadened in variations containing small additions of nickel. But it was quickly learned that they had to have extremely low carbon and nitrogen contents. This meant that these alloys could not be produced by ordinary air-melting methods and would remain unavailable as cast articles.

Even before the ferritic iron-chromium-molybdenum steels were developed there existed a few early duplex alloys which combined austenitic and ferritic matrix structures. These alloys tolerated nitrogen and at least small amounts of carbon, were air-meltable and available as castings. More recently their utility and importance expanded rapidly with the understanding of the importance of small additions of nitrogen. Such additions reduce the unequal partitioning of chromium and molybdenum between the two phases and enhance resistance to pitting, crevice corrosion and stress corrosion failure, resulting in a class of stainless steels that combine some of the best features while sidestepping many of the undesirable characteristics of all of the prior alloy types.

These duplex alloys have found widespread use in the oil and gas industry, notably for line pipe, oil-gas separators, tubing and liners. They have been extensively used on the North Slope of Alaska for gas-gathering-line pipe to handle gas which contains large amounts of water and carbon dioxide which combine to form carbonic acid creating acidity conditions approaching a pH of 3.8. They are also used in a large variety of process equipment such as heat exchangers, tube sheets, tanks, pressure vessels, columns, fluegas scrubbers, shafts, pumps, valves, fittings and piping.

Present duplex alloys in widespread commercial use display critical crevice corrosion temperatures in 6% to 10% ferric chloride solutions of about 40° to 73° F. and critical pitting temperatures of about 95° to about 125° F. This gives an indication of their suitability for use in hot chlorides. A relatively new duplex alloy known as COR25 or Atlas 958 has a critical crevice corrosion temperature of about 100° F. and a critical pitting temperature of about 160° F. with about 18% elongation in standard tensile tests. Alloy 2205, the most widespread currently used duplex alloy has a 25% tensile elongation, 90,000 psi tensile strength and 65,000 psi yield strength but lower corrosion resistance.

Alloy 20Cb3 was once thought to be very cost effective for applications requiring resistance to stress corrosion cracking. This seemed promising, for example, in heat exchanger tubing at a relative cost of about 4 times that of common austenitic stainless steels, while the prior chloride resistant nickel-base alloys have costs about 7 to 8 times the standard stainless steels.

Later the ferritic stainless steels were widely hailed for their low cost due to relatively low strategic element contents, but their process costs remained very high. In the same tubing their performance often equals that of the Ni-base alloys at a relative cost of about 3 times standard 18Cr–8Ni. This is, of course, less even than 20Cb3 but not as low as that of the duplex alloys with their somewhat higher element contents, an example of increased costs due to strategic element content more than offset by reduced production costs.

And so the rapid current developments in duplex stainless steels rightfully deserve the considerable attention and utilization they are presently receiving. In many instances they combine the best properties of the austenitic and the ferritic stainless steels. More and more they are tending to combine the toughness, ductility, weldability and ease of production of austenitic stainless steels as well as the high yield strengths and relatively lower strategic element content of the ferritic stainless steels with the best corrosion resistance properties of both.

As remarkable as these newer duplex alloys are, their goals have been only partially met and there remains a vast demand for improved versions. Even within the group there has remained heretofore a polarization. At one pole are those duplex alloys which have offered the best corrosion properties but at the sacrifice of having the poorest mechanical properties of the group. At the opposite pole is the group of alloys optimizing the best mechanical properties but at the expense of having less corrosion resistance.

SUMMARY OF THE INVENTION

Among the several objects of the present invention, therefore, may be noted the provision of improved duplex alloys resistant to chlorides as well as to a wide range of oxidizing and reducing streams and possessing excellent mechanical properties; the provision of such alloys whose matrix of approximately 25% ferrite to 60% ferrite may be easily produced and maintained; the provision of such alloys which are fabricable and weldable; the provision of such alloys which are immune to local corrosion and stress corrosion cracking in chloride solutions and to intergranular corrosion after welding; the provision of such alloys which may be economically formulated with relatively low proportions of strategic metals, especially nickel; the provision of such alloys as may be readily formulated from such relatively low-cost materials as scraps, ferro-alloys or other commercial melting stock; the provision of such alloys which can be readily cast or wrought; the provision of such alloys with much higher yield strength and hardness than austenitic alloys but tensile elongation at least equal to the most ductile prior art duplex alloys; the provision of such alloys which can be readily be rolled, forged, machined cold formed; and the provision of such alloys which are air-meltable and air-castable.

Briefly, therefore, the present invention is directed to air-meltable, castable, workable, weldable duplex alloys of high yield strength as well as high tensile elongations and ductility which are resistant to chlorides and a wide variety of corrosive chemical streams over a wide range of temperatures and fluid velocities. The duplex alloys of this invention are those alloys consisting essentially of, by weight, between about 23.8% and 28.5% chromium, from about 3.3% to about 5.6% molybdenum, from about 7.8% to about 11.5% nickel, from about 0.12% to about 0.23% nitrogen, from about 0.8% to about 1.5% copper, up to about 0.8% silicon, up to about 1.2% manganese, and up to about 0.6% tungsten, and the balance essentially iron, wherein the percentage of chromium and of molybdenum falls within the area ABCA of FIG. 1.

The alloys of the present invention combine the toughness and mechanical properties heretofore available in duplex alloys with corrosion resistance properties equal or superior to those of the most resistant present day duplex alloys. Prior duplex alloys were held to lower nickel contents in order to maintain approximately half-ferritic, half-austenitic matrices, but the lower nickel contents strongly limited corrosion resistance under reducing conditions. The alloys of the present invention, on the other hand, have been able to maintain the desired structural balance at a higher nickel content, and they have much broader corrosion resistance properties while retaining good ductility and toughness. Furthermore, those alloys of the invention having a substantially equal ferriticaustenitic matrix are more easily formulated when the nickel content is of the order of 9%–11.5%.

DESCRIPTION OF THE PREFERRED EMBODIMENT

Figure 1:
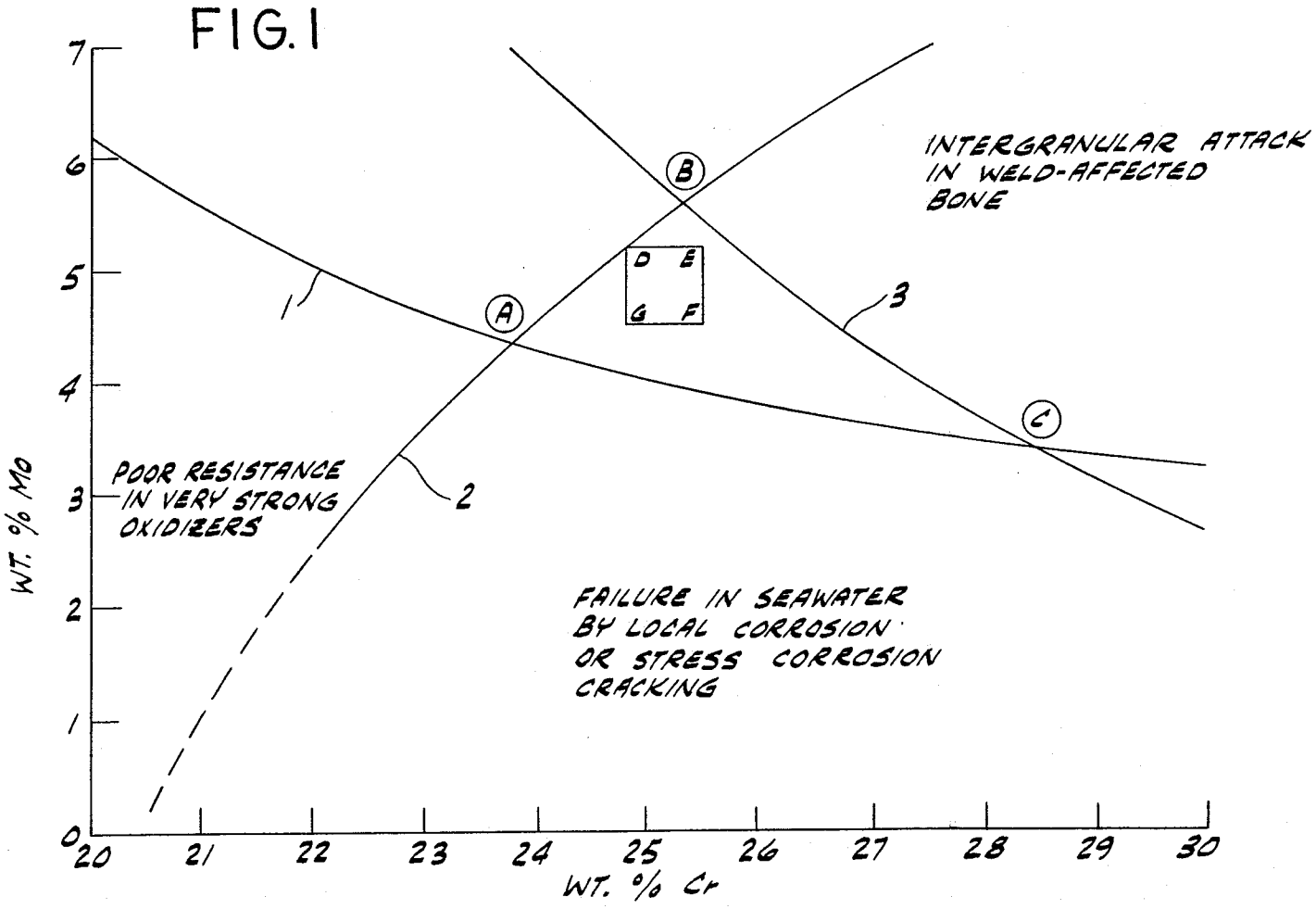
FIG. 1 is a graphic presentation which illustrates the combination of improved properties possessed by the duplex alloys of this invention, i.e., those alloys having chromium and molybdenum percentages falling within the triangular area ABCA. Alloys falling within the area DEFG are particularly preferred because of their greater resistance to reducing environments.

The alloys of the invention contain nickel levels far below those found in nickel-base alloys and the modified austenitic stainless steels employed to resist seawater and chloride solutions but higher than prior commercial duplex alloys. Hence, the new alloys are equally as resistant to oxidizing conditions as alloys of the prior art and are superior to prior duplex alloys under reducing conditions.

The other elements of the alloys of this invention are so chosen and balanced in proportions so that the alloys tend to freeze from the molten state with a matrix of about 25%–60% ferritic structure, preferably about half austenitic and half ferritic structures. The alloys also tend to maintain this balance over a wide range of heat treatments. Furthermore, their nitrogen content is so chosen that the chromium and molybdenum contents tend to be equally partitioned between the two matrix phases even after welding or other rapid temperature changes.

The essential components of the duplex alloys of this invention are:

| | |
|---|---|
| Nickel | 7.8–11.5% by weight |
| Chromium | 23.8–28.5% |
| Molybdenum | 3.4–5.6% |
| Copper | 0.8–1.5% |
| Nitrogen | 0.12–0.23% |
| Iron | Essentially the balance |

Alloys in this chromium range with a molybdenum content greater than about 5.2%, while possessing the improved properties described above, tend to require very high solution annealing temperatures (2100°–2200° F.) in order to avoid the formation of sigma phase. Also, water quenching is often employed as a further guard against sigma formation. However, the combination of high annealing temperatures (which are near the incipient fusion point) and drastic water quenching produce marked warping, sagging, distortion and locked in stresses in cast articles. Further, the parts of normal heat treating furnaces cannot stand temperatures over about 2100° F. without rapid failure, yet the alloys of the invention having the higher molybdenum contents require more expensive furnace equipment. Accordingly, restricting the amount of molybdenum to about 5.2% maximum tends to avoid those problems because the resultant alloys can be annealed at solution temperatures of 1900°–2000° F. and oil quenched.

Nickel contents slightly higher than the preferred 9.6% do not further improve corrosion resistance directly but do retard the structural transformation rate. This is an advantage in that more handling time is allowed in removing ingots from the high temperature furnace and getting them into the forge rolls or in removing castings from the furnace and getting them into the quenching medium. A further advantage is that with thinner or smaller castings even an air quench is sufficient as opposed to an oil or water quench. Nevertheless, nickel contents up to about 11.5% are beneficial metallurgically but increase final material costs slightly.

Alloys having chromium and molybdenum contents such that they fall within the area DEFG are preferred. Among the preferred alloys improvements in different properties of the alloys can also be obtained as described below.

To maximize the combination of improved properties of the duplex alloys of this invention, especially ease of attaining a 50% ferrite/50% austenite structure and good corrosion resistance, the following ranges for the essential components are preferred,

| | |
|---|---|
| Nickel | 7.8–9.6% by weight |
| Chromium | 24.8–25.9% |
| Molybdenum | 4.5–5.2% |
| Copper | 0.8–1.5% |
| Nitrogen | 0.12–0.23% |

-continued

| | |
|---|---|
| Iron | Essentially the balance |

The nickel content of the instant alloys is understood to allow for the inclusion of a small amount of cobalt, for example as naturally occurs in certain ore deposits, without detriment to the alloys. Such amounts should not exceed about 0.3% cobalt.

While the percentage of carbon would be reduced to zero, if possible, nominally the alloys of the invention will also contain carbon up to a maximum of about 0.03% by weight.

Optionally the alloys of the invention may further contain:

Silicon up to 0.8%

Manganese up to 1.2%

Tungsten up to 0.6%

In FIG. 1 there are shown three curves which delineate the changes in corrosion properties experienced by the prior art iron-chromium-molybdenum duplex alloys depending upon the chromium and molybdenum content of those alloys. Thus, curve 1 illustrates those duplex alloys which, in view of their chromium and molybdenum contents, fall below curve 1 and are, therefore, eventually susceptible to local corrosion or stress corrosion cracking. Curve 2 illustrates those duplex alloys which, because of their chromium and molybdenum content, generally fall to the left of curve 2 and which, therefore, have comparatively poor resistance to strong oxidizing substances. Duplex alloys having chromium and molybdenum contents generally falling to the right of curve 3 are susceptible to intergranular corrosion in the weld-affected zones of structures prepared by welding, for example natural gas transmission lines, where it is inconvenient or impossible to reheat the structure after welding is carried out.

On the other hand, those duplex alloys of the invention which have a combination of chromium and molybdenum contents such that they fall within the area ABCA, formed by curves 1, 2 and 3, and have the other essential components within the percentages set forth above, exhibit a unique combination of corrosion resistance to the various forms of corrosion which plague the duplex alloys outside area ABCA.

There is no need for the addition of columbium, tantalum or titanium to the alloys of this invention in order to stabilize the carbon present. It has been found preferable, however, to restrict the ranges of the alloying components to the ranges immediately set forth below to insure against possible sensitization of the alloys to intergranular corrosion or sigma phase formation, (such as might occur in reheating during welding). Otherwise attack of the alloys might occur in very aggressive media, for example boiling 65% nitric acid.

| | |
|---|---|
| Nickel | 8.0-14 9.3% by weight |
| Chromium | 24.8–25.9% |
| Molybdenum | 4.5–5.2% |
| Copper | 0.8–1.5% |
| Nitrogen | 0.12–0.2% |
| Manganese | 0.2–0.9% |
| Silicon | 0.2–0.75% |
| Carbon | 0.027% Maximum |
| Tungsten | 0.6% Maximum |
| Iron | Essentially the balance |

To maintain maximum ductility and elongation along with optimum corrosion resistance properties the alloys of this invention should be even further restricted to the following ranges of percentages, which includes chromium and molybdenum contents within the area DEFT:

| | |
|---|---|
| Nickel | 7.8–9.0% by weight |
| Chromium | 24.8–25.5% |
| Molybdenum | 4.5–5.2% |
| Copper | 0.8–1.3% |
| Nitrogen | 0.12–0.18% |
| Manganese | 0.2–0.8% |
| Silicon | 0.3–0.8% |
| Carbon | 0.025% Maximum |
| Tungsten | 0.6% Maximum |
| Iron | Essentially the balance |

A particularly advantageous formulation having optimum strength, ductility, corrosion resistance and metallurgical properties has the following composition:

| | |
|---|---|
| Nickel | 8.75% |
| Chromium | 24.9% |
| Molybdenum | 4.55% |
| Copper | 1.1% |
| Nitrogen | 0.15% |
| Manganese | 0.5% |
| Silicon | 0.5% |
| Carbon | 0.02% |
| Iron | Essentially the balance |

The following examples further illustrate the

EXAMPLE 1

One hundred pound heats of several different compositions were prepared in accordance with the invention.

Each of the heats was air-melted in a 100-pound high frequency induction furnace. The compositions of these heats is set forth in Table I, the balance in each instance being essentially iron.

TABLE I

| ALLOY NUMBER | | ALLOYS OF THE INVENTION PERCENT BY WEIGHT OF ALLOYING ELEMENTS | | | | | | | | |
|---|---|---|---|---|---|---|---|---|---|---|
| | | Ni | Cr | Mo | Cu | Mn | N | C | Si | W |
| 1454 | within | 10.41 | 26.62 | 4.09 | 1.02 | 0.57 | 0.16 | 0.02 | 0.68 | — |
| 1490 | | 9.44 | 24.42 | 4.58 | 1.16 | 0.62 | 0.28 | 0.01 | 0.26 | — |
| 1491 | area | 11.55 | 25.37 | 5.31 | 0.93 | 0.73 | 0.17 | 0.02 | 0.44 | — |
| 1501 | | 8.78 | 25.91 | 4.26 | 1.33 | 0.67 | 0.21 | 0.02 | 0.54 | — |
| 1502 | ABCA | 9.86 | 27.13 | 4.07 | 1.21 | 0.53 | 0.19 | 0.01 | 0.31 | — |
| 2434 | | 8.91 | 25.06 | 4.66 | 1.23 | 0.28 | 0.14 | 0.01 | 0.66 | — |
| 2435 | within | 8.73 | 24.90 | 4.54 | 1.08 | 0.49 | 0.15 | 0.02 | 0.49 | — |
| 2436 | | 8.86 | 24.88 | 4.95 | 1.12 | 0.41 | 0.16 | 0.02 | 0.40 | 0.36 |
| 2444 | area | 8.77 | 25.21 | 4.55 | 1.02 | 0.81 | 0.14 | 0.02 | 0.52 | — |
| 2445 | | 8.82 | 24.96 | 4.62 | 0.97 | 0.86 | 0.18 | 0.00 | 0.60 | 0.41 |
| 2446 | DEFG | 9.02 | 25.02 | 4.78 | 1.33 | 1.11 | 0.17 | 0.01 | 0.46 | — |

TABLE I-continued

| ALLOYS OF THE INVENTION PERCENT BY WEIGHT OF ALLOYING ELEMENTS | | | | | | | | | |
|---|---|---|---|---|---|---|---|---|---|
| ALLOY NUMBER | Ni | Cr | Mo | Cu | Mn | N | C | Si | W |
| 1457 | 8.11 | 25.01 | 4.56 | 1.03 | 0.61 | 0.15 | 0.01 | 0.60 | — |
| 1458 | 8.02 | 25.22 | 4.55 | 0.82 | 0.71 | 0.19 | 0.01 | 0.54 | 0.31 |

Standard physical test blocks and corrosion test bars were prepared from each heat, then solution annealed for two hours at 1950° F., and air quenched. Standard tensile test bars were then machined from each heat and the mechanical properties of each were measured. The results of these measurements are set forth in Table II.

TABLE II

| MECHANICAL PROPERTIES OF ALLOYS OF THE INVENTION | | | | | |
|---|---|---|---|---|---|
| ALLOY NUMBER | | TENSILE STRENGTH P.S.I. | YIELD STRENGTH P.S.I. | TENSILE ELONGATION % | BRINELL HARDNESS NUMBER |
| 1454 | within | 119,200 | 81,000 | 27.0 | 225 |
| 1490 | | 127,000 | 93,100 | 31.0 | 255 |
| 1491 | area | 129,000 | 99,000 | 29.0 | 261 |
| 1501 | | 113,400 | 72,600 | 30.0 | 241 |
| 1502 | ABCA | 121,500 | 88,800 | 28.0 | 248 |
| 2434 | | 98,500 | 60,800 | 26.0 | 210 |
| 2435 | within | 106,800 | 63,740 | 26.5 | 228 |
| 2436 | | 108,000 | 64,500 | 25.5 | 235 |
| 2444 | area | 103,500 | 63,800 | 24.5 | 230 |
| 2445 | | 102,200 | 61,200 | 28.0 | 215 |
| 2446 | DEFG | 105,400 | 62,300 | 26.0 | 200 |
| 1457 | | 127,500 | 93,500 | 25.0 | 255 |
| 1458 | | 113,100 | 77,500 | 30.0 | 241 |

Corrosion test bars were machined into 1½ inch diameter by ¼ inch thick discs, each having a 1/8 inch diameter hole in the center. These discs were carefully machined to size and then polished to a 600-grit finish and pickled 5 hours in 35% nitric acid at 80° C. to remove any dust, oil, or foreign matter, rinsed in water and dried.

These discs were then used in the comparative corrosion tests described hereinafter, comparing performance of the alloys of the invention with that of prior art alloys which are similar but do not conform to alloys of this invention. The compositions of the comparative alloys are set forth in Table III.

TABLE III

| COMPARATIVE ALLOYS PERCENT BY WEIGHT OF ALLOYING ELEMENTS | | | | | | | | |
|---|---|---|---|---|---|---|---|---|
| ALLOY DESIGNATION | Ni | Cr | Mo | Cu | Mn | N | C | Si |
| Ferralium 255 | 6.11 | 25.02 | 3.11 | 2.04 | 0.89 | 0.22 | 0.03 | 0.67 |
| 2205 | 4.98 | 22.21 | 3.03 | — | 0.93 | 0.16 | 0.02 | 0.46 |
| 317L | 11.16 | 18.31 | 3.43 | — | 1.03 | — | 0.02 | 0.88 |
| AL6X | 24.17 | 21.33 | 6.10 | — | 0.82 | 0.23 | 0.02 | 0.56 |
| 254SMO | 18.44 | 20.12 | 6.16 | 0.96 | 0.78 | 0.21 | 0.01 | 0.37 |
| VEWA963 | 16.23 | 17.11 | 6.31 | 1.66 | 0.77 | — | 0.02 | 0.44 |
| COR25 | 7.03 | 24.96 | 4.54 | — | 0.66 | 0.24 | 0.01 | 0.46 |
| 7-Mo PLUS | 4.82 | 26.52 | 1.52 | — | 0.61 | 0.21 | 0.05 | 0.52 |
| 945 | 12.92 | 28.69 | 4.45 | 1.95 | 0.86 | 0.21 | 0.08 | 0.44 |
| 1442 | 11.13 | 22.50 | 6.34 | 2.91 | 0.42 | 0.15 | 0.02 | 0.70 |
| 1443 | 8.87 | 23.03 | 5.31 | 0 | 0.54 | 0.15 | 0.03 | 0.26 |
| 1444 | 8.66 | 22.71 | 5.65 | 2.22 | 0.68 | 0.15 | 0.02 | 0.61 |
| 1447 | 11.62 | 25.08 | 6.71 | .04 | 0.44 | 0.15 | 0.02 | 0.25 |
| 1448 | 8.85 | 22.02 | 6.93 | .03 | 0.32 | 0.25 | 0.01 | 0.46 |
| 1493 | 12.16 | 26.86 | 4.72 | 1.88 | 0.66 | 0.17 | 0.06 | 0.36 |

The mechanical properties of the commercial comparative alloys, as furnished by the manufacturers, are set forth in Table IV.

TABLE IV

| MECHANICAL PROPERTIES OF COMPARATIVE ALLOYS | | | |
|---|---|---|---|
| ALLOY DESIGNATION | TENSILE STRENGTH P.S.I | YIELD STRENGTH P.S.I. | TENSILE ELONGATION % |
| Ferralium 255 | 110,000 | 80,000 | 25 |
| 2205 | 90,000 | 65,000 | 25 |
| 317L | 70,000 | 25,000 | 40 |
| AL6X | 90,000 | 40,000 | 45 |
| 254SMO | 95,000 | 44,000 | 35 |
| VEWA963 | 87,000 | 43,500 | 35 |
| COR25 | 100,000 | 75,000 | 18 |
| 7-Mo PLUS | 90,000 | 70,000 | 15 |

In Table IV, all of the mechanical properties given are for the annealed condition, that is, prior to any cold working, to keep them all on the same comparative basis. Alloys 317L, AL6X, 254SMO, and VEWA963 are all of the fully austenitic variety while the remaining alloys are duplex stainless steels.

EXAMPLE 2

Using the disc samples of Example 1, samples of the invention were immersed to a depth of about 1¾ inches in natural seawater taken from the Atlantic Ocean at Myrtle Beach, South Carolina. The seawater was held at room temperature in Plastic containers with tightly-fitting lids for six months with a change of water every two weeks. At the end of the six month period none of the samples of the invention showed any pits, rust or discoloration when examined under a 10-power magnifying glass.

EXAMPLE 3

Further disc samples were similarly placed in Plastic containers as in Example 2 but employing a salt water solution prepared by dissolving 4 ounces per gallon of ordinary uniodized table salt in distilled water to which was also added enough concentrated 70% nitric acid to bring the solution to a pH of 1.7 measured by a digital pH meter.

The solution was changed in these containers every week until a total exposure time of six months was reached. These samples were carefully weighed to the nearest 10,000th of a gram before and after exposure. Again, no blemishes, pits, or discoloration were visible under a 10-power magnifying glass and no measurable weight loss was recorded.

EXAMPLE 4

Disc samples of the alloy of the invention and of the comparative commercial alloys were suspended in 70% nitric acid solution for 48 hours while similar tests were run in boiling 65% nitric acid for 8 hours. Also, the other prior art alloys listed in Table III were compared with alloys of this invention in boiling 65% nitric acid for 72 hours. The nitric acid test reveals susceptability to intergranular corrosion or the presence of a sigma phase. The results of these tests are set forth in Table V. In the corrosion data the units employed to measure corrosion depth are mils. On mil equals 0.001 inch or 0.00254001 centimeter. The rate of corrosion attack is expressed in mils per year, M.P.Y. A rate of 10 M.P.Y. or less is usually required in chemical process equipment or transmission lines.

TABLE V

CORROSION RATE IN MILS OF PENETRATION PER YEAR (M.P.Y.) IN 70% NITRIC ACID AT 80° C. AND IN BOILING 65% NITRIC ACID

| ALLOY DESIGNATION | 70% $HNO_3$ 80° C. | BOILING 65% $HNO_3$ | BOILING 65% $HNO_3$ (72 hours) |
|---|---|---|---|
| 1454 within | — | — | 5.6* |
| 1490 | — | — | 4.6* |
| 1491 area | — | — | 4.3* |
| 1501 | — | — | 2.7* |
| 1502 ABCA | — | — | 6.4* |
| 2434 | 1.1 | 8.7 | 8.6* |
| 2435 within | 0.9 | 9.6 | — |
| 2436 | 1.2 | 2.7 | 3.1* |
| 2444 area | 1.0 | 7.3 | — |
| 2445 | 1.2 | 8.1 | — |
| 2446 DEFG | 1.1 | 6.6 | — |
| 1457 | 0.9 | 3.7 | 3.8* |
| 1458 | 1.1 | 4.6 | 4.2* |
| Ferralium 255 | 1.8 | 5.0 | — |
| 2205 | 4.4 | 20.6 | — |
| 317L | 3.8 | 20.8 | — |
| AL6X | 7.6 | 36.5 | — |
| 254SMO | 3.5 | 171.3 | — |
| VEWA963 | 6.3 | 235.7 | — |
| COR25 | 1.2 | 49.4 | — |
| 7-Mo PLUS | 1.1 | 4.8 | — |
| 945 | | | 186.8* |
| 1442 | | | 36.5 |
| 1443 | | | 46.6 |
| 1444 | | | 52.2 |
| 1447 | | | 44.6 |
| 1448 | | | 70.9 |
| 1493 | | | 115.0* |

*For these tests, the sample discs were autogenously heliarc welded on both faces with an "X" surrounded by a ring and tested without reheating.

Since 4 to 10 MPY is the usual allowable maximum, the data in Table V illustrates that all of the comparative alloys show very poor performance in hot nitric acid as compared to alloys of the invention.

EXAMPLE 5

Sulfuric acid solutions are reducing in nature up to about 80% acid strength and such solutions provide an excellent measure of the resistance of various alloys to reducing chemical substances. Accordingly, samples of the alloys of the invention were then tested along with the comparative alloys in plain sulfuric acid-water solutions of various reducing concentrations for 48 hours at 80° C. The results of these tests are set forth in Table VI.

TABLE VI

CORROSION RATE IN MILS OF PENETRATION PER YEAR (M.P.Y.) IN 10%, 25%, 40% AND 50% PLAIN SULFURIC ACID-WATER SOLUTIONS AT 80° C.

| ALLOY DESIGNATION | 10% | 25% | 40% | 50% |
|---|---|---|---|---|
| 1454 within | 0.0 | 7.8 | 5.1 | — |
| 1490 | 0.0 | 7.1 | 6.5 | — |
| 1491 area | 0.0 | 5.8 | 4.2 | — |
| 1501 | 0.0 | 4.8 | 2.9 | — |
| 1502 ABCA | 0.0 | 7.6 | 6.3 | — |
| 2434 | 0.0 | 0.0 | 4.1 | 1.4 |
| 2435 within | 0.0 | 0.0 | 3.6 | 0.7 |
| 2436 | 0.0 | 0.0 | 3.2 | 1.4 |
| 2444 area | 0.0 | 0.0 | 5.0 | 2.4 |
| 2445 | 0.0 | 0.0 | 0.0 | 0.3 |
| 2446 DEFG | 0.0 | 0.0 | 5.0 | 2.4 |
| 1457 | 0.0 | 0.0 | 1.8 | 0.6 |
| 1458 | 0.0 | 2.7 | 0.0 | 0.2 |
| Ferralium 255 | 1.6 | 16.2 | 10.7 | 9.6 |
| 2205 | 8.2 | 49.1 | 26.6 | 32.6 |
| 317L | 53.0 | 156.5 | 536.0 | 634.6 |
| AL6X | 6.0 | 9.5 | 10.2 | 13.2 |
| 254SMO | 49.1 | 16.2 | 75.1 | 34.0 |
| VEWA963 | 36.2 | 62.7 | 74.2 | 75.1 |
| COR25 | 3.6 | 15.9 | 22.5 | 31.7 |
| 7-Mo PLUS | 58.1 | 165.4 | 618.8 | 712.6 |
| 945 | 521.9 | 721.5 | 73.9* | — |
| 1493 | 0.0 | 188.2 | 75.2* | — |
| 1447 | 58.7 | 142.6 | 106.2 | — |
| 1443 | 2.1 | 1033.2 | 1121.6 | — |
| 1442 | 34.8 | 35.0 | 39.6 | — |
| 1448 | 3.6 | 15.9 | 29.8 | — |

*In 40% sulfuric acid at 60° C. alloy 945 showed no attack and alloy 1493 gave a result of 1.3 MPY attack.

EXAMPLE 6

Samples of the alloys of the invention were also tested for 48 hours at 80° C., in 10%, 25%, 40%, 50% and 97% sulfuric acid-water solutions to which had been added ¼% nitric acid. Nitric acid is a very strong oxidizer so that these test solutions of 50% or lower sulfuric acid plus the nitric acid represented mixed oxidizing and reducing conditions. The 97% sulfuric acid is a weak oxidizer but very corrosive to ordinary duplex alloys. The presence of such a small amount of nitric acid was sufficient to control attack of the concentrated sulfuric upon samples of the alloy of the invention. In all of these tests no sample of the invention in any of these solutions exceeded 4 mils per year of attack.

EXAMPLE 7

Samples of the alloy of the invention along with comparative alloys were then tested for 48 hours in (1) boiling solutions of 3% sodium chloride, (2) one-tenth normal (0.1N) sulfuric acid plus 5% sodium chloride, and (3) 0.8% sodium chloride plus 0.5% citric acid. The samples of the alloy of the invention suffered no measurable attack in the first and second solutions above and none exceeded 3½ M.P.Y. in the last solution. Ferralium 255 was the only comparative alloy to have less than 10 M.P.Y. attack in each of the three solutions. The other commercial and non-commercial comparative alloys suffered over 10 M.P.Y. in at least one of the three and were usually drastically attacked by the 5% sodium chloride plus one-tenth normal sulfuric acid solution.

From the foregoing, it is evident that the duplex alloys of the present invention have greatly improved performance over duplex alloys of the prior art.

As various changes can be made in the alloys of the invention without departing from the scope of the invention, it is intended that all matter contained in the above description shall be interpreted as illustrative and not in a limiting sense.

What is claimed is:

1. A two-phase alloy which is weldable, is resistant to sea water and has good resistance to strong oxidizing substances, comprising a ferritic phase and an austenitic phase in which the ferritic phase is from about 25% to about 60% of the alloy, said alloy consisting essentially of:

| | |
|---|---|
| Nickel | 7.8 to 11.5% by weight |
| Chromium | 23.8 to 28.5% |
| Molybdenum | 3.4 to 5.6% |
| Copper | 0.8 to 1.5% |
| Nitrogen | 0.12 to 0.23% |
| Iron | Essentially the balance |

provided that the percentage of chromium and of molybdenum falls within the area ABCA of FIG. 1.

2. An alloy of claim 1 wherein the carbon content is a maximum of about 0.03% by weight.

3. An alloy of claim 2 wherein the chromium content is in the range of 24.8% to 25.5% and the molybdenum content is in the range of 4.5% to 5.2%.

4. An alloy of claim 3 wherein the nickel content is in the range of 7.8% to 9.6%.

5. An alloy of claim 4 further containing:

| | |
|---|---|
| Silicon | up to 0.8% by weight |
| Manganese | up to 1.2% |
| Tungsten | up to 0.6% |

6. An alloy of claim 3 consisting essentially of:

| | |
|---|---|
| Nickel | 8.0 to 9.3% by weight |
| Chromium | 24.8 to 25.5% |
| Molybdenum | 4.5 to 5.2% |
| Copper | 0.8 to 1.5% |
| Nitrogen | 0.12 to 0.2% |
| Manganese | 0.2 to 0.9% |
| Silicon | 0.2 to 0.75% |
| Carbon | 0.027% maximum |
| Tungsten | 0.6% maximum |
| Iron | Essentially the balance |

7. An alloy of claim 3 consisting essentially of:

| | |
|---|---|
| Nickel | 8.75% by weight |
| Chromium | 24.9% |
| Molybdenum | 4.55% |
| Copper | 1.1% |
| Nitrogen | 0.15% |
| Manganese | 0.5% |
| Silicon | 0.5% |
| Carbon | 0.02% maximum |
| Iron | Essentially the balance |

8. An alloy of anyone of claims 1–7 wherein the ferritic phase and the austenitic phase are present in substantially equal amounts.

* * * * *